US006902318B2

(12) United States Patent
Watanabe

(10) Patent No.: US 6,902,318 B2
(45) Date of Patent: Jun. 7, 2005

(54) THERMOMETER FOR ENGINE OF VEHICLE

(75) Inventor: Hiromi Watanabe, Yokosuka (JP)

(73) Assignee: Oppama Industry Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/470,724

(22) PCT Filed: Feb. 14, 2002

(86) PCT No.: PCT/JP02/01263

§ 371 (c)(1),
(2), (4) Date: Jul. 31, 2003

(87) PCT Pub. No.: WO02/065076

PCT Pub. Date: Aug. 22, 2002

(65) Prior Publication Data

US 2004/0062291 A1 Apr. 1, 2004

(30) Foreign Application Priority Data

Feb. 15, 2001 (JP) ..... 2001-037957
Feb. 23, 2001 (JP) ..... 2001-047723

(51) Int. Cl.[7] ..... G05D 23/00; G01K 7/16; G01K 13/00

(52) U.S. Cl. ..... 374/141; 374/144; 701/1; 340/584

(58) Field of Search ..... 374/141, 144, 374/148, 183, 185, 170, 208; 340/870.16, 870.17, 584; 327/101; 701/1

(56) References Cited

U.S. PATENT DOCUMENTS 3,931,619 A * 1/1976 Moore et al. ..... 73/116
4,321,543 A * 3/1982 Tuska ..... 324/433
4,600,866 A * 7/1986 Seto ..... 388/809
4,622,637 A * 11/1986 Tomita et al. ..... 701/64
4,783,175 A * 11/1988 Sugimori ..... 374/170
4,977,862 A * 12/1990 Aihara et al. ..... 123/41.12
5,485,374 A * 1/1996 Takaku et al. ..... 701/29
5,744,973 A * 4/1998 Bird ..... 324/707
5,975,066 A * 11/1999 Morikami ..... 123/674
6,169,953 B1 * 1/2001 Panoushek et al. ..... 701/99
6,286,992 B1 * 9/2001 Kyrtsos ..... 374/45
6,424,157 B1 * 7/2002 Gollomp et al. ..... 324/430
6,570,508 B1 * 5/2003 Kvenvold ..... 340/870.17
2002/0078933 A1 * 6/2002 Hiraku et al. ..... 123/549
2002/0135488 A1 * 9/2002 Hibbs et al. ..... 340/584

FOREIGN PATENT DOCUMENTS

JP 59-005960 1/1984
JP 60-7630 1/1985
JP 60-001513 1/1985
JP 60-187833 9/1985
JP 63-202230 8/1988
JP 07260958 A * 10/1995 ..... G04F/10/00
JP 2000244844 A * 9/2000 ..... H04N/5/63
SU 1016696 A * 5/1983 ..... G01K/7/32

OTHER PUBLICATIONS

English Language Abstracts of Jap. Pat. Nos. 59–005960, 60–001513, 60–7630, 60–187833 and 63–202230 Copy of International Search Report.

* cited by examiner

*Primary Examiner*—Gail Verbitsky
(74) *Attorney, Agent, or Firm*—Michael Bednarek; Shaw Pittman LLP

(57) ABSTRACT

Provided is a thermometer that is mounted on an engine incorporated in a vehicle and that measures the temperature of the engine during running of the vehicle. A temperature/resistance element included in the thermometer senses the temperature of the engine all the time. The sensed temperature is displayed on a display. Furthermore, a temperature warning indicator indicates whether the sensed temperature exceeds a warning set temperature. While monitoring the sensed temperature and temperature warning indication, a driver can accelerate the vehicle or shift the transmission gear so as to retain a load on the engine in an optimal state.

15 Claims, 13 Drawing Sheets

THERMOMETER FOR ENGINE OF VEHICLE

TECHNICAL FIELD

The present invention relates to a thermometer for an engine of a vehicle that is optionally incorporated in a vehicle such as a racing two-wheel or four-wheel vehicle and that monitors the temperature of the engine so as to assist in driving the engine or driving a vehicle in an optimal state.

BACKGROUND ART

A thermometer that measures the incessantly changing temperature of an engine during running of a vehicle, digitizes the result of measurement, and displays the temperature is not incorporated in a racing two-wheel or four-wheel vehicle (including a cart). When it says that the temperature of an engine is measured, it signifies that the temperature of an engine main unit including cylinders is directly measured using a sensor. Otherwise, it signifies the measurement of the temperature of a radiator which cools cooling water heated by the engine or the measurement of the temperature of a cooling water flowing through a water pipe linking a water jacket, which encloses the cylinders, and the radiator. Otherwise, it signifies the measurement of the temperature of oil that is reserved in an oil pan located below the engine main unit and that flows through a circulation path.

By the way, managing the temperature of the engine during racing is very important in order to allow the engine to operate efficiently so as to attain a predetermined vehicle speed on a stable basis. Through the temperature management, occurrence of a fault such as the overheating of the engine or the seizure of a piston or a valve accompanying the overheating can be avoided.

Moreover, during racing, a transmission gear must be shifted based on the running speed of a vehicle or a road condition as well as an engine speed. A driver must perform this action by intuition.

However, a conventional two-wheel or four-wheel vehicle does not include a thermometer that indicates the incessantly changing temperature of an engine while measuring it. A driver must trust his/her intuition so as to accelerate the vehicle by stepping on an accelerator pedal or to shift a transmission gear by handling a shift level. Consequently, the performance of the engine may not be fully drawn out but the vehicle may be driven in a high-fuel consumption and high-noise condition. Moreover, when an engine speed is too high, that is, when the engine is overheated, if the transmission gear is shifted, a relatively small mechanical stress applied to the engine, a transmission, or a clutch may bring about a critical damage.

Accordingly, an object of the present invention is to provide a thermometer for an engine of a vehicle that is optionally incorporated in a vehicle such as an existing two-wheel or four-wheel vehicle, and that can readily measure and display the incessantly changing temperature of an engine during running of the vehicle. Thus, the vehicle can be driven in an optimal situation in which no stress is applied to the engine. When the measured temperature of the engine exceeds a set value, a warning indication is given so that, for example, an acceleration lever can be handled in order to restore the engine to an optimal driven state or restore the vehicle to an optimal driven state.

DISCLOSURE OF INVENTION

A thermometer for an engine of a vehicle in accordance with the present invention consists mainly of: a temperature/resistance element that is mounted on part of an engine incorporated in a vehicle and that detects the temperature of the engine as a change in resistance; a resistance-frequency converter that is optionally connected to the temperature/resistance element and converts the change in resistance into a change in frequency; a computer that calculates the temperature of the engine on the basis of an output of the resistance-frequency converter which represents the frequency and that displays the temperature on a display; and a key entry setting unit for use in setting a warning temperature of the engine to a value selected from among a plurality of predetermined values and thus determining the warning temperature. When the temperature of the engine exceeds the warning set temperature determined using the key entry setting unit, the computer instructs a temperature warning indicator to give a warning indication. Consequently, a driver discerns the incessantly changing temperature of the engine and whether the temperature of the engine has reached a set warning level. Thus, the driver can drive the vehicle with the engine retained in an optimal driven state.

A thermometer for an engine of a vehicle in accordance with another embodiment of the present invention includes: a battery voltage detecting unit that detects a voltage across a battery incorporated in a vehicle and converts the frequency of the voltage; and a voltage warning indicator that gives a warning indication when the voltage across the battery exceeds a pre-set warning set voltage. A computer calculates the voltage across the battery on the basis of a frequency represented by an output of the battery voltage detecting unit, and displays the calculated voltage across the battery on a display. When the voltage across the battery exceeds the warning set voltage determined using a key entry setting unit, the voltage warning indicator gives a warning indication. According to the embodiment, a driver immediately discerns whether the voltage across the battery and the incessantly changing temperature of the engine have reached a voltage of a set warning level and a temperature of a set warning level respectively. The driver can continue driving the vehicle with the engine retained in an optimal driven state. Moreover, occurrence of an error in a set value of the temperature of the engine derived from degradation in the quality of the battery can be prevented.

A thermometer for an engine of a vehicle in accordance with another embodiment of the present invention includes an engine speed detecting unit that detects an engine speed. A computer calculates the engine speed on the basis of an output of the engine speed detecting unit. When the calculated engine speed is equal to or larger than a shift timing point revolution speed and equal to or smaller than a shift timing warning set revolution speed, a shift timing point indicator is actuated. According to the present embodiment, a driver discerns the incessantly changing temperature of the engine and whether the temperature has reached a set warning level. Moreover, the present embodiment helps the driver grasp a shift timing point suitable for the engine speed. Consequently, driving the engine and driving a vehicle can be achieved efficiently according to a vehicle speed.

In a thermometer for an engine of a vehicle in accordance with another embodiment of the present invention, a computer has the ability to convert the temperature of an engine, which is obtained using a resistance-frequency converter, from a Celsius temperature to a Fahrenheit temperature or vice versa. Consequently, a driver of any nationality can discern the temperature of the engine so as to prevent overheating, and can thus drive the vehicle appropriately.

In a thermometer for an engine of a vehicle in accordance with still another embodiment of the present invention, a warning temperature setting unit can be used to determine a warning temperature in either Celsius or Fahrenheit. Consequently, a driver of any nationality can recognize the warning temperature so as to prevent the overheating of the engine, and can thus drive a vehicle appropriately.

In a thermometer for an engine of a vehicle in accordance with still another embodiment of the present invention, a battery voltage detecting unit includes a frequency division circuit that produces a signal whose frequency corresponds to an integral submultiple of the frequency into which the frequency of the voltage across a battery is converted and whose timing matches the data processing timing at which a computer processes data. Thus, the voltage across the battery detected in an analog form is converged into a signal that can be dealt with by the computer, and then immediately dealt with internally.

In a thermometer for an engine of a vehicle in accordance with still another embodiment of the present invention, a key entry unit is realized with a key matrix unit. This is because the keys included in the key matrix unit can be used to determine a warning temperature, a warning voltage, and a setting of a timer, to store, display, or reset a maximum temperature of an engine, and to designate whether the functions of circuits are activated or inactivated automatically or manually at the time of starting or stopping the engine. Consequently, the key entry unit having a compact structure is used to designate and determine one mode or a plurality of modes relevant to the engine.

In a thermometer for an engine of a vehicle in accordance with still another embodiment of the present invention, times measured during running of a vehicle are displayed on a display in stopwatch mode. In the stopwatch mode that is designated using a key entry unit, stopwatch measurement, lap time measurement, and split second measurement, or lap time/split second storage is carried out. Consequently, a racer can immediately discern the lap time or split second during driving, and easily check the vehicle speed per unit time.

A thermometer for an engine of a vehicle in accordance with still another embodiment of the present invention includes a Celsius/Fahrenheit display setting unit that is used to specify in a computer whether the temperature of an engine obtained using a resistance-frequency converter is displayed on a display in either Celsius or Fahrenheit. Consequently, display in Celsius and display in Fahrenheit can be selectively achieved externally.

In a thermometer for an engine of a vehicle in accordance with still another embodiment of the present invention, after an engine is stopped, when a set time has elapsed, a computer automatically halts the functions of all circuits except the function of a timer. Consequently, unnecessary power supply to the circuits during stoppage or suspension of driving can be ceased, and consumption of battery power can be minimized.

A thermometer for an engine of a vehicle in accordance with still another embodiment of the present invention includes a shift timing warning indicator that is driven when an engine speed detected by an engine speed detecting unit becomes equal to or higher than a shift timing warning set revolution speed determined using a key entry unit. Consequently, when the detected engine speed exceeds any of shift timing warning set revolution speeds determined in units of, for example, 100 rpm, shifting a transmission gear is avoided.

BEST MODE FOR CARRYING OUT THE INVENTION

Figure 1:
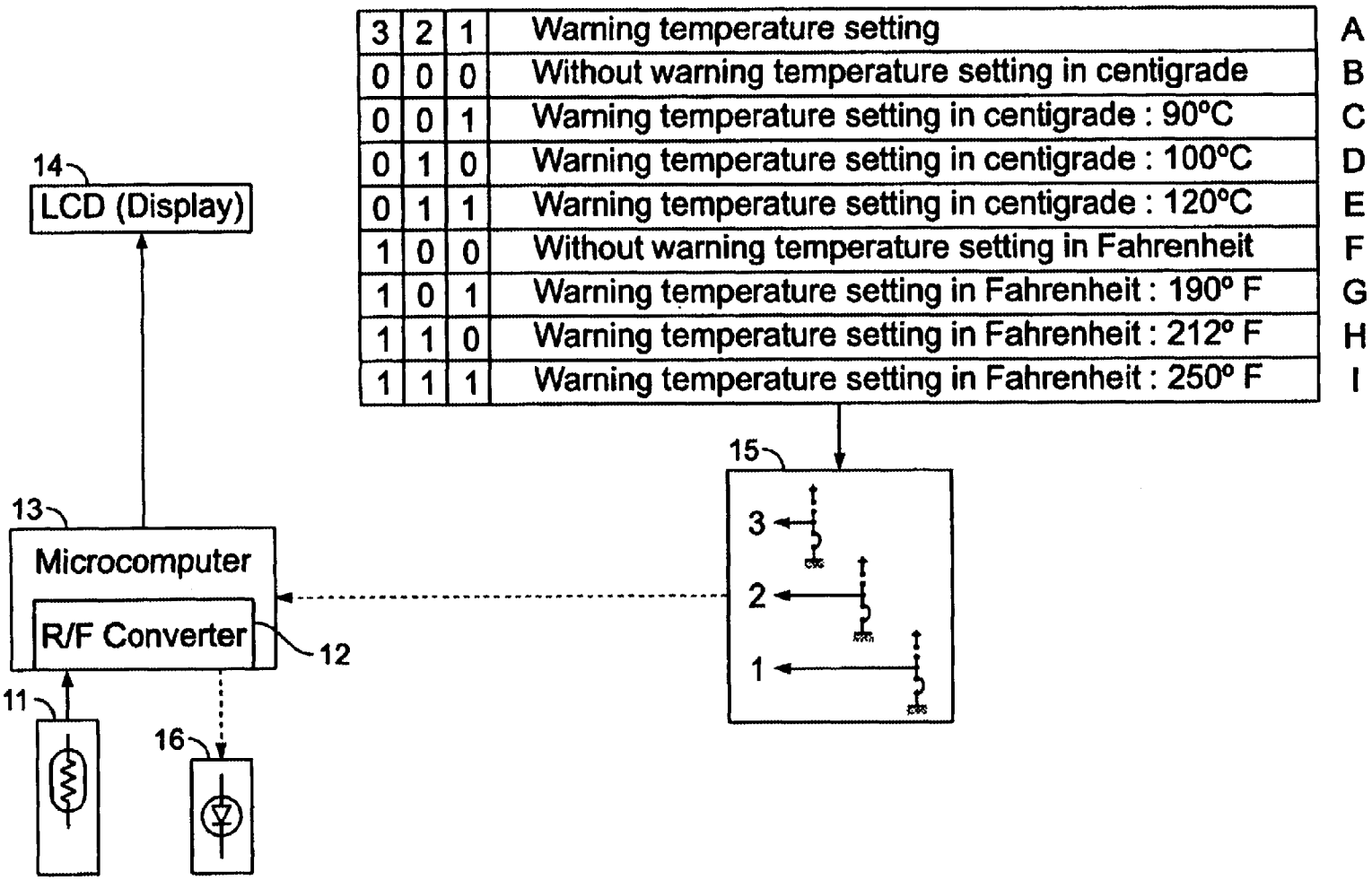
FIG. 1 is a block diagram showing a thermometer for an engine of a vehicle in accordance with an embodiment of the present invention.

For full details of the present invention, the present invention will be described in conjunction with the appended drawings. Referring to FIG. 1, a thermometer for an engine of a vehicle in accordance with an embodiment includes: a temperature/resistance element 11 such as a thermistor; a resistance-frequency converter 12 connected to the temperature/resistance element 11; a computer 13 having the resistance-frequency converter 12; a display 14 on which the temperature of an engine or the voltage across a battery is displayed; a warning temperature setting unit 15 serving as a key entry unit; and a temperature warning indicator 16.

The temperature/resistance element 11 is mounted on part of the engine incorporated in a vehicle, and detects the temperature of the engine as a change in resistance. The resistance-frequency converter 12 converts a change in resistance detected by the temperature/resistance element 11 into a change in frequency which a computer to be described later can deal with. Moreover, the computer 13 calculates the temperature of the engine on the basis of a frequency represented by an output of the resistance-frequency converter 12. The computer 13 then displays the calculated temperature on the display 14. The computer 13 has the resistance-frequency converter 12 incorporated therein.

The warning temperature setting unit 15 is used to determine a warning temperature of the engine. The warning temperature is set to any value selected from among a plurality of predetermined values by inserting a jumper or by typing keys. When the temperature of the engine exceeds the warning set temperature determined by the warning temperature setting unit 15, the temperature warning indicator 16 gives a warning indication by lighting a light-emitting diode or the like.

Moreover, the computer 13 converts the temperature of the engine obtained using the resistance-frequency converter 12 from a Celsius temperature to a Fahrenheit temperature or vice versa. Furthermore, the warning temperature setting unit 15 is designed so that the warning temperature can be determined in either Celsius or Fahrenheit. The warning temperature setting unit 15 includes, for example, three keys. Owing to the keys, the warning temperature in Celsius can be determined in four such manners that: the warning temperature is left undetermined; the warning temperature is set to 90° Celsius; the warning temperature is set to 100° Celsius; and the warning temperature is set to 120° Celsius. On the other hand, the warning temperature in Fahrenheit can be determined in four such manners that: the warning temperature is left undetermined; the warning temperature is set to 190° Fahrenheit, the warning temperature is set to 212° Fahrenheit, and the warning temperature is set to 250° Fahrenheit.

Figure 2:
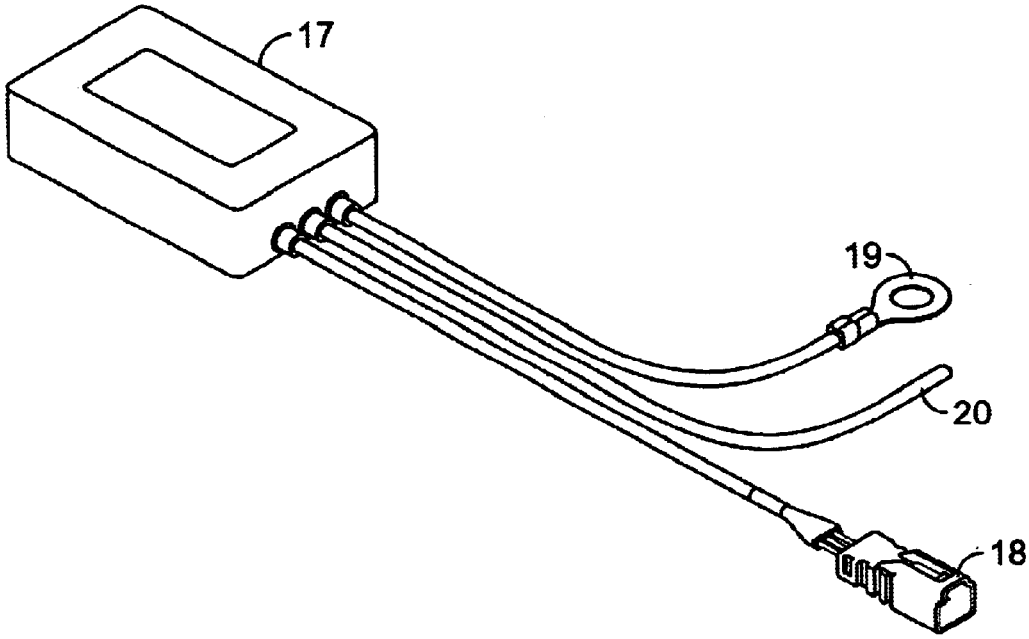
FIG. 2 is a perspective view of the thermometer for an engine of a vehicle shown in FIG. 1.

FIG. 2 is a perspective view showing the appearance of the thermometer for an engine of a vehicle that has the computer 13, display 14, warning temperature setting unit 15, and temperature warning indicator 16 housed in a case 17. Referring to FIG. 2, reference numeral 18 denotes a connector connected to the computer 13 over a lead. The connector 18 can be optionally coupled to a contact pin (not shown) included in the temperature/resistance element 11 mounted on part of the engine. Reference numerals 19 and 20 denote power terminals which are coupled to the positive and negative electrodes of the battery and through which power is supplied to the circuits including the computer 13 and being housed in the case 17.

Next, typical temperature measurement to be performed by the foregoing thermometer for an engine of a vehicle will be described in conjunction with the flowchart of FIG. 3. When a power switch (not shown) is turned on, various kinds of counters and registers are initialized automatically (step S1). Thereafter, a main program is activated (step S2). Moreover, a watchdog timer is repeatedly reset in order to detect an abnormality in the hardware of the computer 13 (step S3). Thereafter, temperature measurement including calculation of the temperature of the engine in accordance with the present invention is executed (step S4). The result of the measurement is displayed on the display (step S5).

It is checked whether the temperature measurement is still in progress (step S6). If the temperature measurement is still in progress, the watchdog timer is reset and the steps of measuring the temperature and of displaying data on the display are executed again. On the other hand, when the temperature measurement is completed, a timer interrupt is received in response to a request for an interrupt (step S7). When the program is terminated, a halt instruction is issued (step S8). The low power consumption mode is validated, and reception of an interrupt is inhibited (step S9). The processing succeeding the step S3 of resetting the watchdog timer is executed again.

Figure 3:
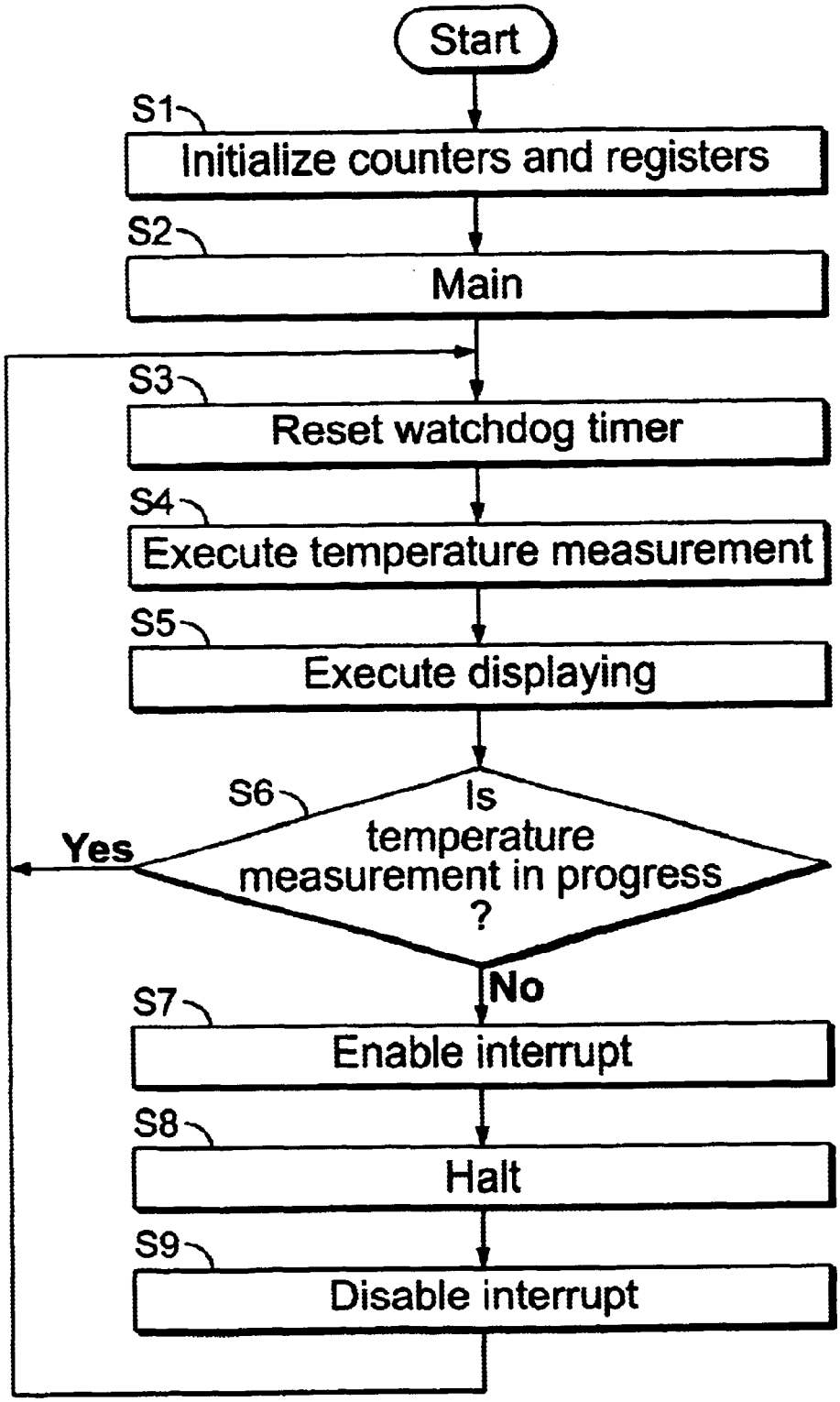
FIG. 3 is a flowchart describing a flow of actions performed in the thermometer for an engine of a vehicle shown in FIG. 1.
Figure 4:
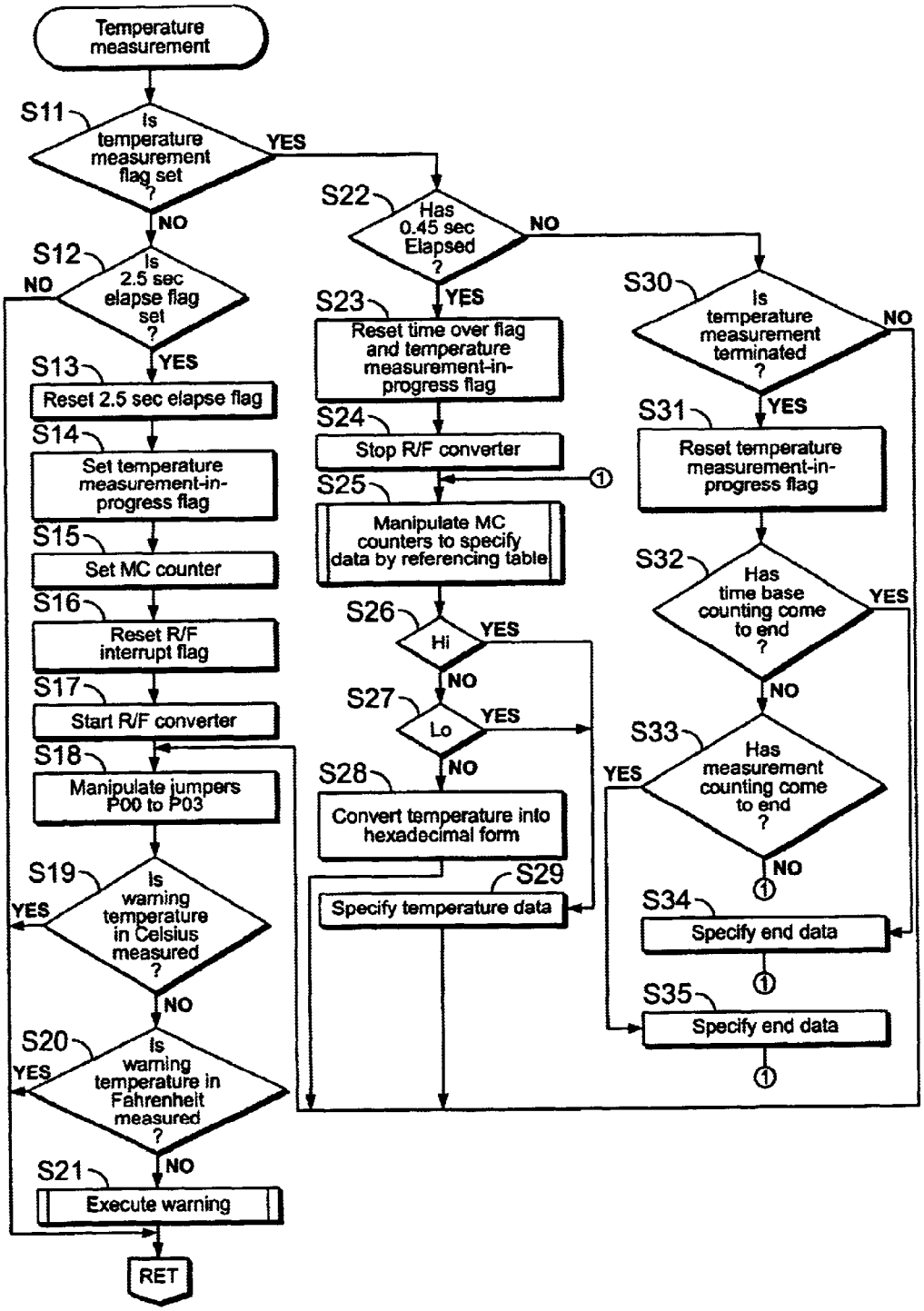
FIG. 4 is a flowchart describing a procedure of temperature measurement that is performed by the thermometer for an engine of a vehicle shown in FIG. 1.

FIG. 4 is a flowchart detailing the procedure of temperature measurement mentioned in FIG. 3. Referring to FIG. 4, first, if temperature measurement using the temperature/resistance element 11 is executed, it is checked whether a temperature measurement flag is set (step S11). If the temperature measurement flag is not set, it is checked if 2.5 sec has elapsed, that is, a 2.5 sec elapse flag is set (step S12). When 2.5 sec has elapsed, the flag is reset (step S13). The time of 2.5 sec is regarded as a temperature measurement interval.

Temperature measurement is then started. A temperature measurement-in-progress flag is set (step S12). A counter incorporated in the computer 13 is set (step S15). Thereafter, an interrupt factor flag incorporated in the resistance-frequency converter 12 is reset, and a state attained before the interrupt is restored (step S16). The resistance-frequency converter is started acting (step S17). Thereafter, the warning temperature setting unit 15 is used to determine a warning temperature set value that is applied to an input port (step S18). It is then verified whether a warning temperature in Celsius has been measured (step S19). If the warning temperature in Celsius has been measured, it is verified whether a warning temperature in Fahrenheit is measured, that is, a temperature being measured has reached the warning set temperature (step S20). If the temperature being measured has reached the warning set temperature, warning is executed (step S21).

If it is verified at step S11 that the temperature measurement flag is set, it is checked if 0.45 sec has elapsed (step S22). If 0.45 sec has elapsed, a time over flag and the temperature measurement-in-progress flag are reset (step S23). The resistance-frequency converter 12 is stopped acting (step S24).

Thereafter, warning temperature data listed in a table like the one shown in FIG. 1 is specified using the counters incorporated in the computer 13 (step S25). It is verified whether a measured temperature is higher or lower than the warning set temperature determined using the warning temperature setting unit 15 (step S27 and step S27). If the measured temperature is higher or lower, the warning temperature data is specified to represent the temperature (step S29). Thereafter, step S18 and subsequent steps are executed. If the measured temperature is neither higher nor lower, the temperature is converted into a hexadecimal form (step S28). The step S18 and subsequent steps are then executed.

If it is verified at step S22 that 0.45 sec has not elapsed, it is checked whether temperature measurement is completed (step S30). If the temperature measurement is completed, the temperature measurement-in-progress flag is reset (step S31). It is then checked whether time base counting has come to an end (step S32). If the time base counting has not come to an end, it is checked if measurement counting has come to an end (step S33). If the measurement counting has not come to an end, step S25 and subsequent steps are carried out.

Figure 5:
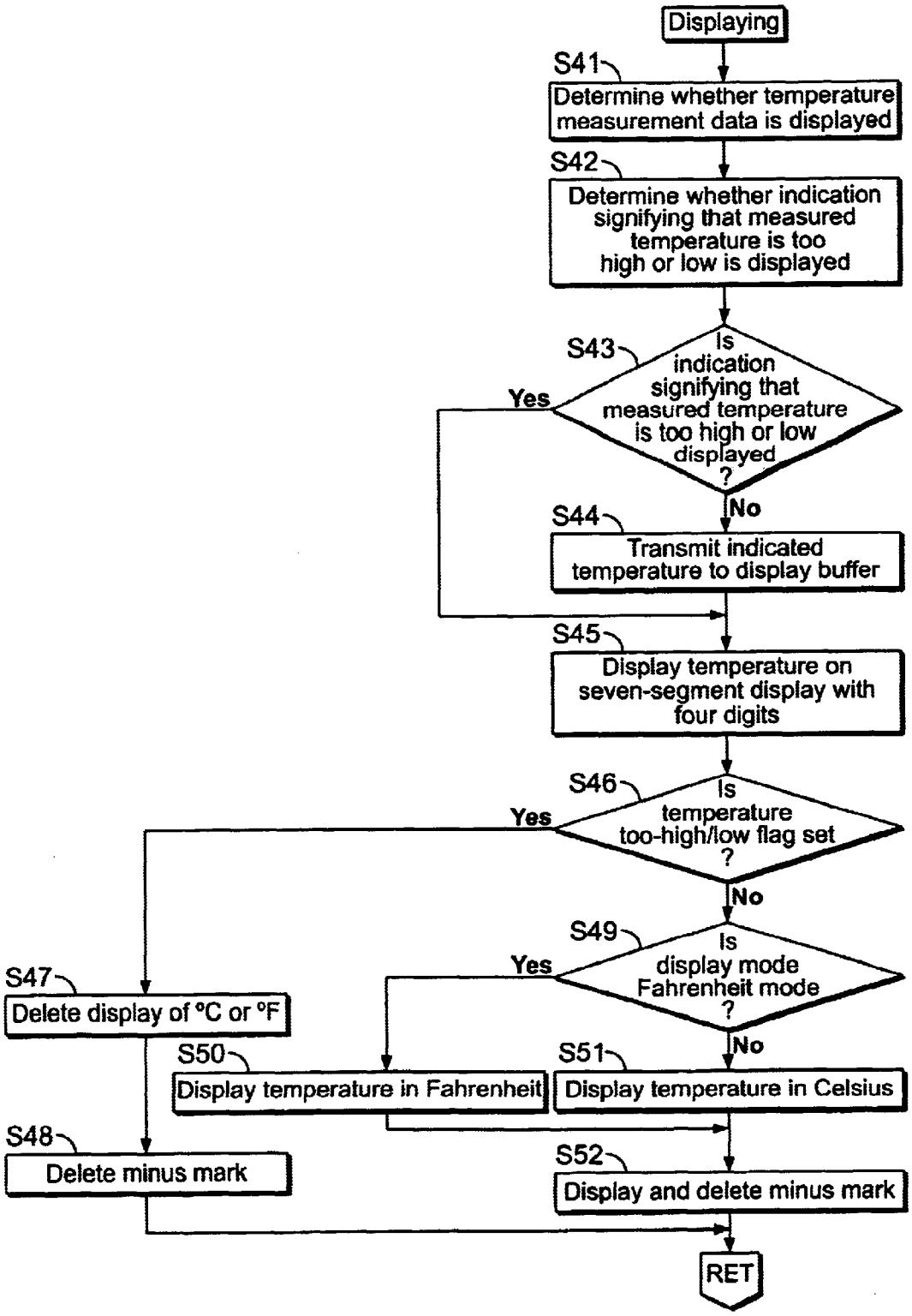
FIG. 5 is a flowchart describing a procedure of displaying that is performed by the thermometer for an engine of a vehicle shown in FIG. 1.

If the time base counting or measurement counting has come to an end, end data is specified (step S34, step S35). The step S25 and subsequent steps are then carried out. If it is verified at step S30 that temperature measurement is not completed, step S18 and subsequent steps are carried out. FIG. 5 is a flowchart detailing a procedure of displaying mentioned in FIG. 3. Herein, whether temperature measurement data is displayed is determined (step S41). Whether an indication signifying that a measured temperature is too high or low is displayed is indicated (step S42). The indication is displayed when the measured temperature falls outside a predetermined range of measured temperature values. Thereafter, it is checked whether the indication signifying that the measured temperature is too high or low is displayed (step S43). If the indication is not displayed, an indicated temperature is transmitted to a display buffer that is not shown (step S44). The temperature is displayed with four digits on a seven-segment display (step S45).

Incidentally, when it says that the indication signifying that the temperature is too high or low is displayed, it means that High or Low is displayed directly on the seven-segment display. Thereafter, it is checked if a temperature-too-high/low flag is set. If the flag is set, the display of degrees Celsius or Fahrenheit is deleted (step S47), and a minus mark is deleted (step S48).

If it is verified at step S46 that the temperature-too-high/low flag is not set, it is checked whether the current temperature display mode is a Fahrenheit mode (step S49). If the current mode is the Fahrenheit mode, a temperature is displayed in Fahrenheit (step S51). The minus mark is displayed and deleted (step S52).

Figure 6:
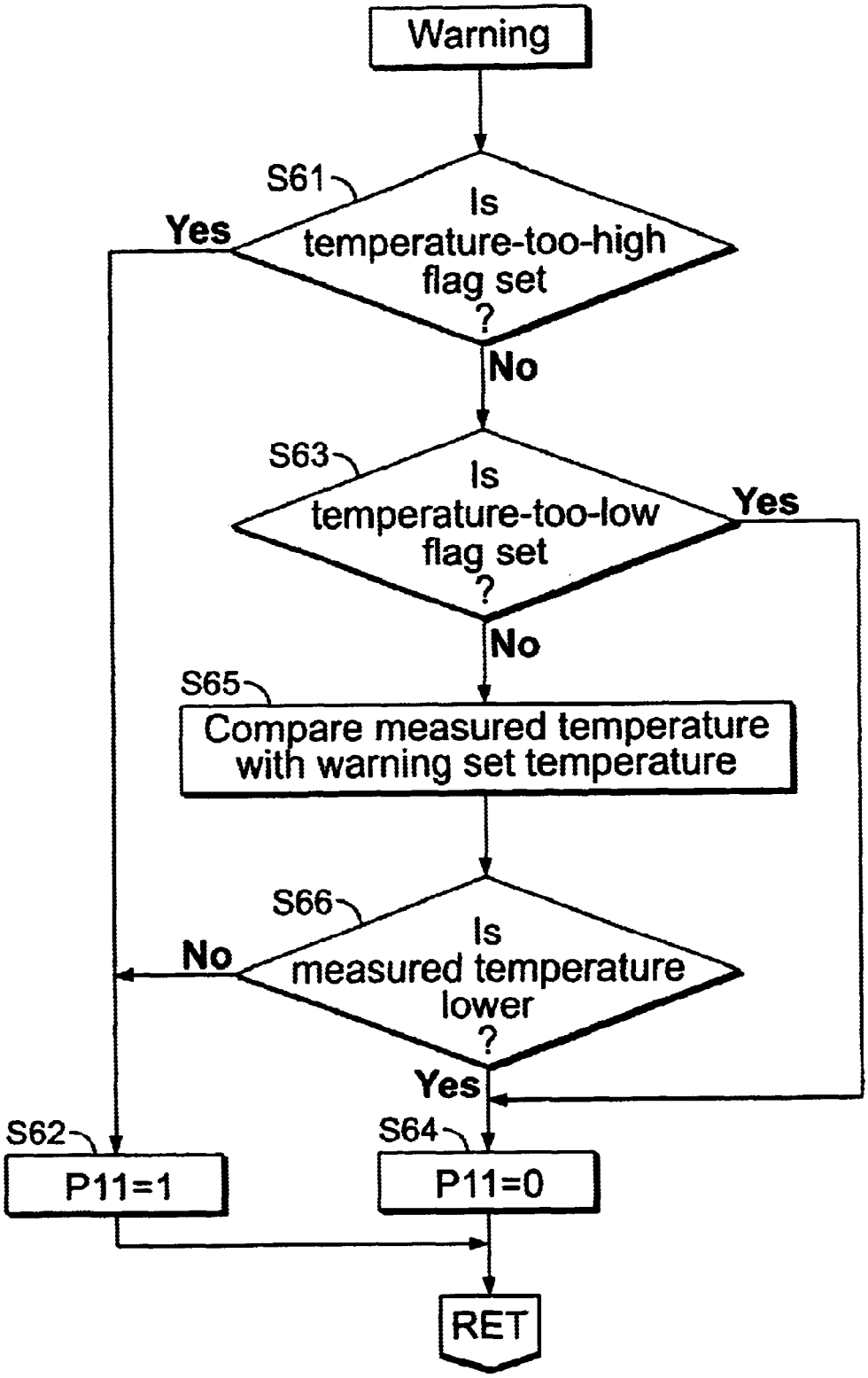
FIG. 6 is a flowchart describing a procedure of temperature warning that is performed by the thermometer for an engine of a vehicle shown in FIG. 1.

FIG. 6 is a flowchart detailing a procedure of temperature warning mentioned in FIG. 4. Referring to FIG. 6, first, it is checked whether a measured temperature-too-high flag is set (step S61). If the temperature-too-high flag is set, a warning signal is applied to an output port (step S62). If the temperature-too-high flag is not set, it is checked if a temperature-too-low flag is set (step S63). If the temperature-too-low flag is set, the warning signal is not applied to the output port (step S64).

If the temperature-too-low flag is not set, the measured temperature is compared with the warning set temperature (step S65). It is then verified whether the measured temperature is lower than the warning set temperature (step S66). If it is verified that the measured temperature is lower, the warning signal is not transmitted (step S64). If the measured temperature is not lower, the warning signal is transmitted (step S62).

As mentioned above, according to the present invention, the warning set temperature can be set to any of values that are different from one another in units of, for example, 1° Celsius. When the measured temperature of the engine detected using the temperature/resistance element exceeds the thus determined warning set temperature, the temperature warning indicator 16 gives a warning. This prompts a driver to drive a vehicle in a direction in which the engine temperature drops. Consequently, overheating of the engine can be avoided. In this case, the temperature of the engine can be measured in either Celsius or Fahrenheit. Moreover, the warning set temperature can be set to any value in Celsius or Fahrenheit. Consequently, a driver of any nationality can recognize the temperature of an engine so as to avoid overheating, and can therefore drive a vehicle appropriately.

Figure 7:
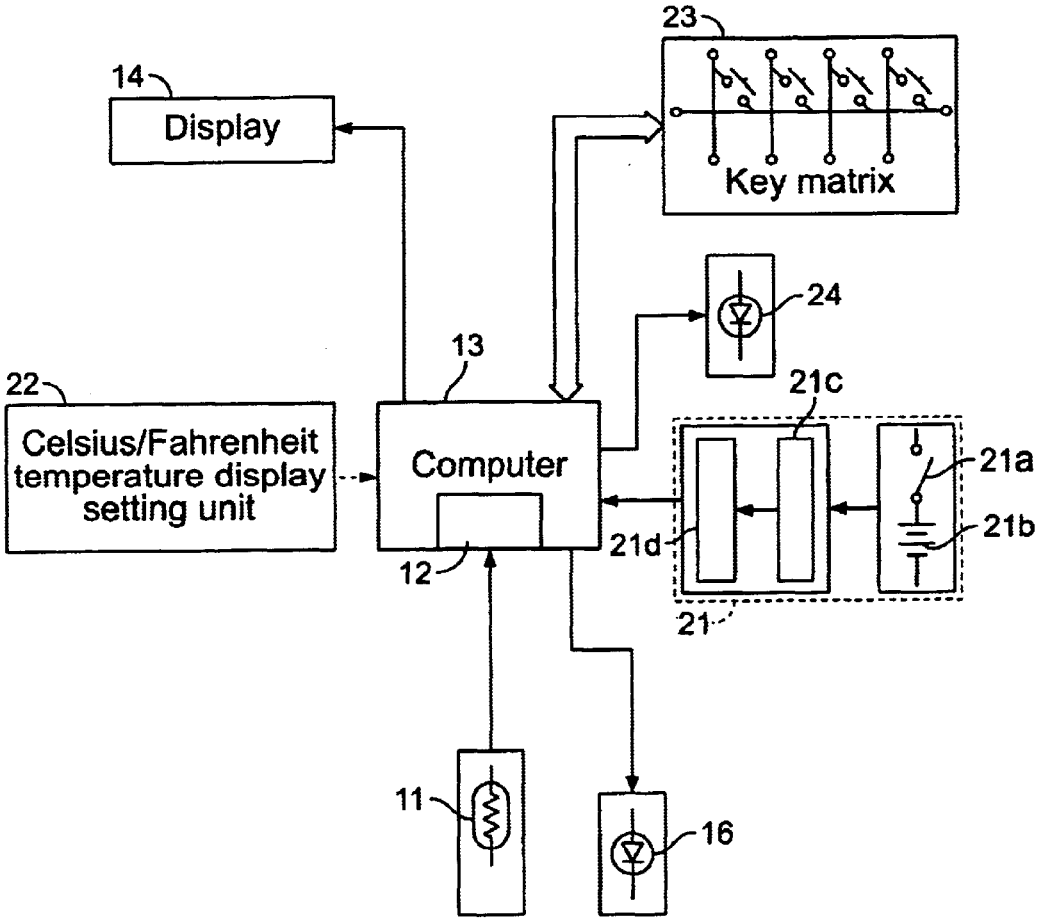
FIG. 7 is a block diagram showing a thermometer for an engine of a vehicle in accordance with another embodiment of the present invention.

Next, referring to FIG. 7, another embodiment of the present invention will be described. In FIG. 7, the same reference numerals are assigned to components identical to those shown in FIG. 1. A temperature/resistance element 11 is mounted on part of an engine incorporated in a vehicle, and detects the temperature of the engine as a change in resistance. A resistance-frequency converter 12 converts a change in resistance detected by the temperature/resistance element 11 into a change in frequency which a computer to be described later can deal with. The resistance-frequency converter 12 is incorporated in the computer, and optionally connected to the temperature/resistance element 11 using a lead or the like.

Moreover, the computer 13 calculates the temperature of the engine on the basis of a frequency represented by an output of the resistance-frequency converter 12, and displays the temperature on a display 14. Based on a detection signal produced by a battery voltage detecting unit 21 that will be described later, the computer 13 calculates a voltage across a power supply battery and displays it on the display 14.

The battery voltage detecting unit 21 includes: a voltage/frequency converter 21*c* that converts the frequency of a terminal voltage of a battery 21*b* serving as an internal battery connected in series with a power switch 21*a*; and a frequency division circuit 21*d* that produces a signal whose frequency is an integral submultiple of the frequency represented by an output of the voltage/frequency converter 21*c* and which can be readily dealt with by the computer 13.

The computer 13 works out either a Celsius or Fahrenheit temperature value on the basis of temperature data produced by the resistance-frequency converter 12. Moreover, the computer 13 calculates the voltage across the battery on the basis of an output of the battery voltage detecting unit 2 that represents the detected voltage. Moreover, the computer 13 expresses the temperature of the engine in Celsius or Fahrenheit according to the settings of switches included in a Celsius/Fahrenheit temperature display setting unit 22, and displays the temperature on the display 14.

Figure 8:
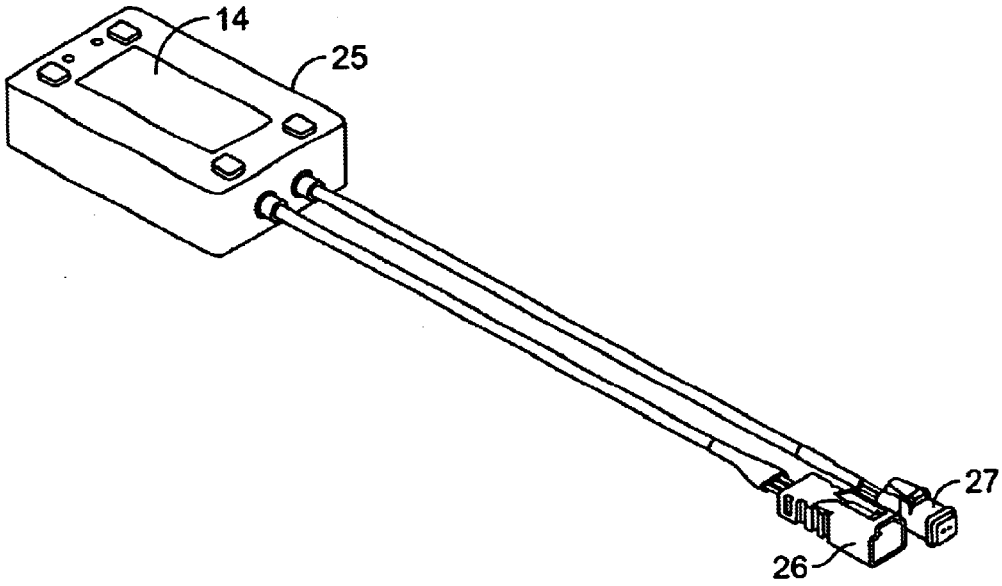
FIG. 8 is a perspective view of the thermometer for an engine of a vehicle shown in FIG. 7.

Furthermore, reference numeral 23 denotes a key matrix unit serving as a key entry unit. The key matrix unit is used to determine a warning temperature of the engine or a warning temperature of the battery, to store, display, or reset a maximum temperature, to determine the setting of a timer, or to designate that the functions of circuits other than the timer are automatically or manually halted in case the engine is stopped. The key matrix unit 23 has a plurality of key switches used to perform the above actions. Reference numeral 16 denotes a temperature warning indicator. When the temperature of the engine exceeds a warning set temperature determined using the key matrix unit 23, the computer 13 instructs the temperature warning indicator 16 to give a warning indication. FIG. 8 is a perspective view showing the thermometer for an engine of a vehicle having the circuit components, which include the computer 13, display 14, battery voltage detecting unit 21, Celsius/Fahrenheit temperature display setting unit 22, key matrix unit 23, temperature warning indicator 16, and voltage warning indicator 24, housed in a case 25. Referring to FIG. 8, reference numeral 26 denotes a connector connected to the computer 13 over a lead. The connector 26 can be optionally coupled to a contact pin (not shown) of the temperature/resistance element 11 mounted on part of the engine. Reference numeral 27 denotes a connector that is coupled to a power terminal through which power is supplied to the circuits including the computer 13 and being housed in the case 25. The connector 27 is connected to the electrodes of the battery.

Next, typical actions to be performed mainly by the computer 13 shown in FIG. 7 in the thermometer for an engine of a vehicle will be described in conjunction with the flowchart of FIG. 9. When a power switch is turned on, various kinds of counters and registers are initialized (step S71). Thereafter, a main program is activated (step S72). After the main program is terminated, clock processing is performed, that is, a reference clock is generated based on an output of a timer incorporated in the computer 13, and the number of clock pulses is counted (step S73).

Furthermore, key entry is performed, that is, various data items are entered at the key matrix unit 23 that is a key entry unit in order to initiate data processing to be performed by the computer 13 (step S74). First, engine temperature measurement in accordance with the present invention is executed (step S75). Thereafter, voltage measurement and SVD measurement are executed for the battery 21*b* (step S76 and step S77). The results of the steps S76 and S77 are displayed by executing displaying (step S78). When the program is terminated, halting is executed (step S79). After the halting is completed (step S80), step S73 and subsequent steps are executed again.

Figure 9:
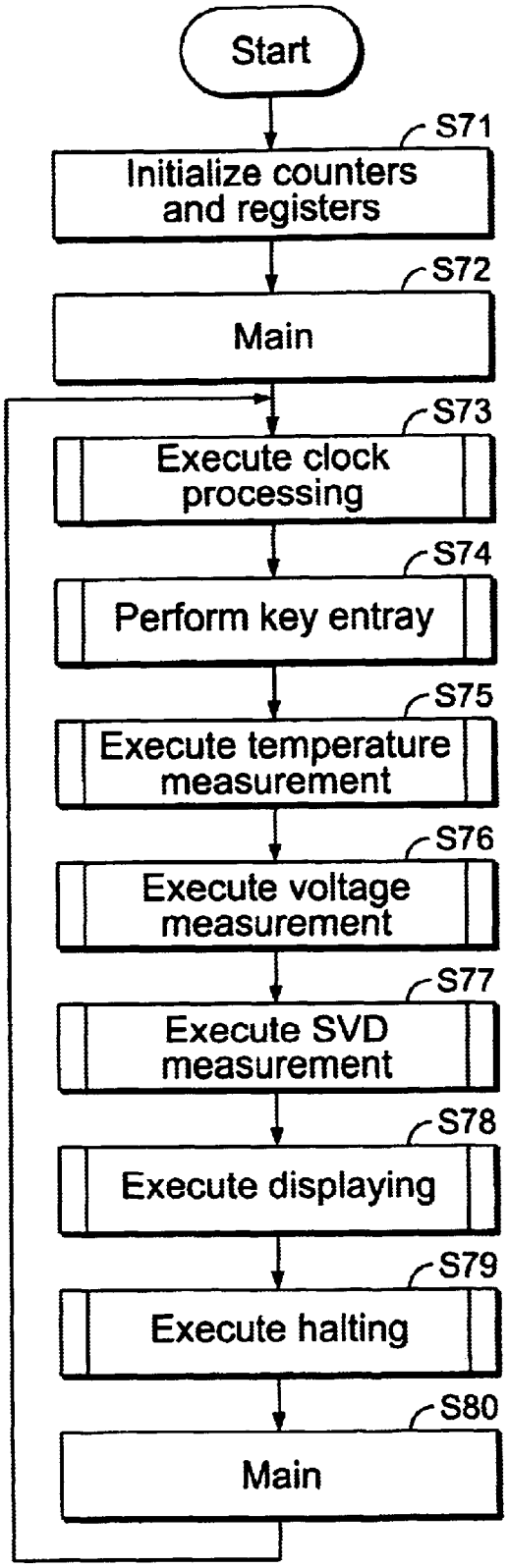
FIG. 9 is a flowchart describing a flow of actions that is performed by the thermometer for an engine of a vehicle shown in FIG. 7.

Moreover, the procedures of temperature measurement, displaying, and temperature warning mentioned in FIG. 9 are identical to those described in conjunction with FIG. 4, FIG. 5, and FIG. 6. Reiteration will be averted.

Figure 10:
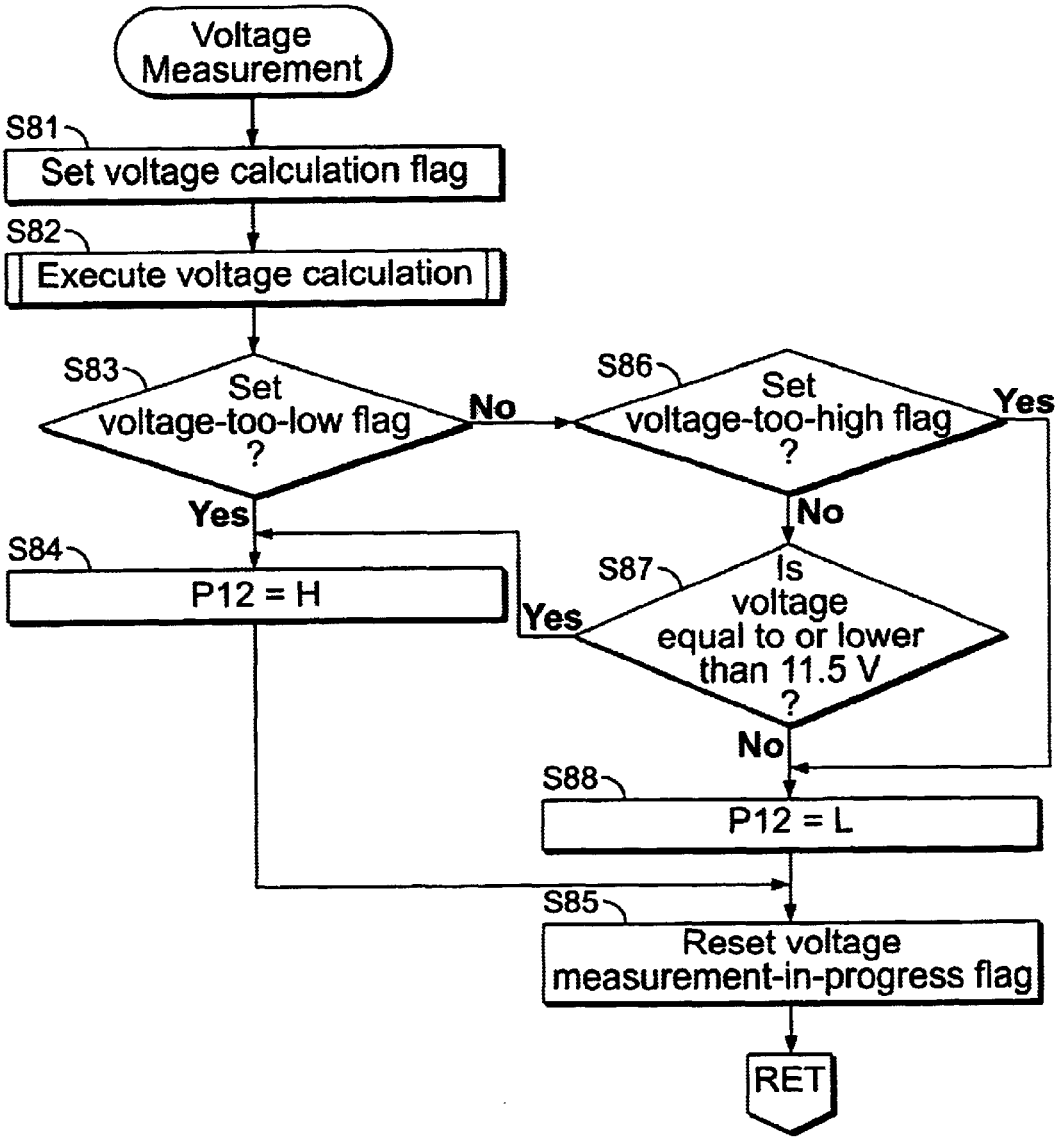
FIG. 10 is a flowchart detailing a procedure of voltage measurement mentioned in FIG. 9.

FIG. 10 is a flowchart detailing the procedure of voltage measurement performed by the computer 13. Herein, when voltage measurement is executed, a voltage calculation flag is set (step S81). A voltage is calculated based on an output of the battery voltage detecting unit 21 that represents a detected voltage (step S82). It is checked if a voltage-too-low flag is set relative to the calculated voltage (step S83). If the voltage-too-low flag is set, a high-level signal is applied to the input port. The computer 13 instructs the voltage warning indicator 24 to give a warning indication (step S84). Thereafter, a voltage measurement-in-progress flag is reset and voltage measurement is terminated (step S85).

Figure 11:
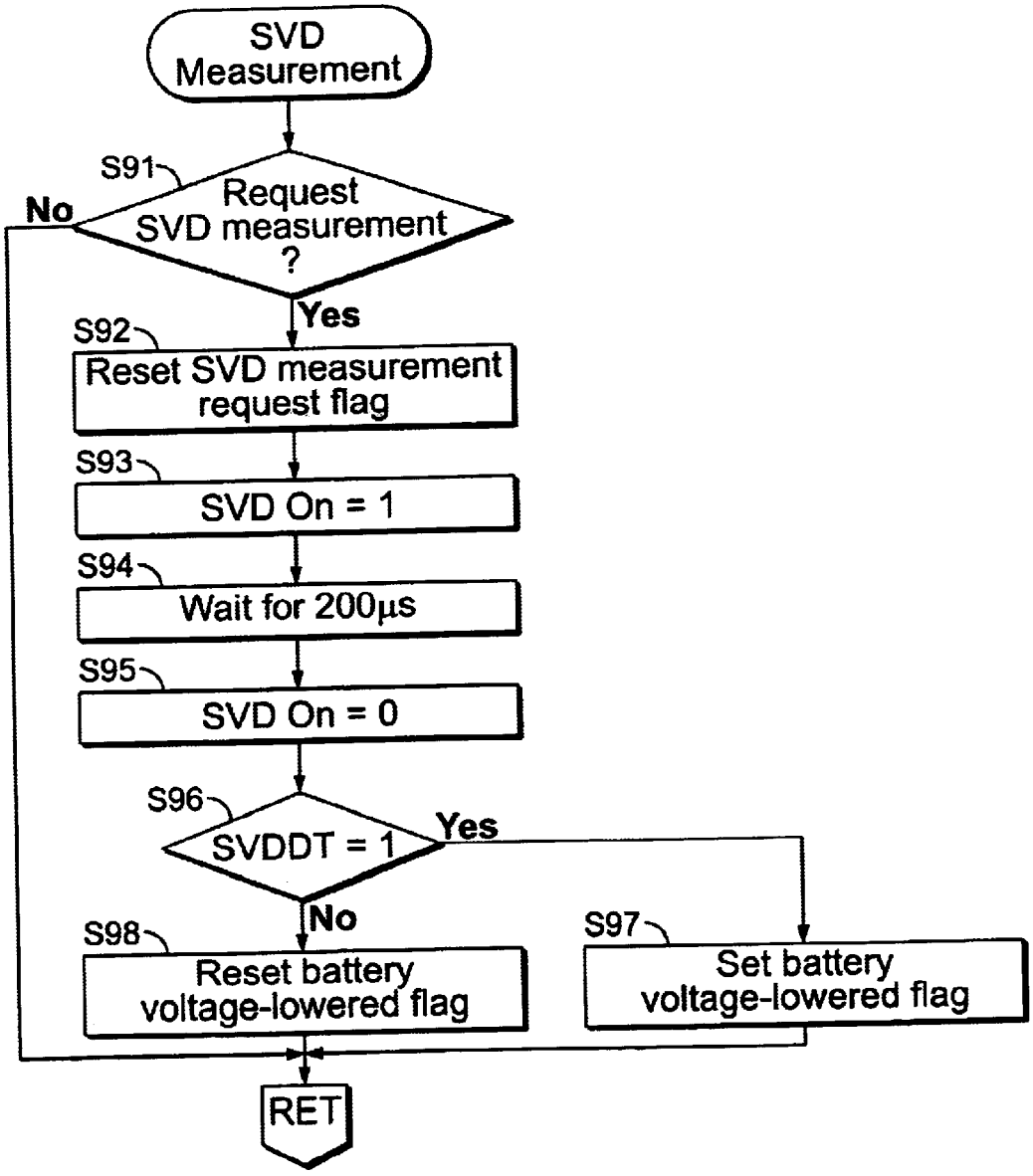
FIG. 11 is a flowchart detailing a procedure of SVD measurement mentioned in FIG. 9.

On the other hand, if it is verified at step S83 that the voltage-too-low flag is not set, it is checked if a voltage-too-high flag is set (step S86). If the voltage-too-high flag is not set, it is checked if the measured voltage is equal to or lower than a pre-set value of 11.5 V (step S87). If the measured voltage is equal to or lower than 11.5 V, step S84 and subsequent steps are executed. In contrast, if the measured voltage is not equal to or lower than 11.5 V, a low-level signal is applied to the input port (step S88). Thereafter, step S85 is executed. Moreover, if it is found at step S86 that the voltage-too-high flag is set, the low-level signal is immediately applied to the input port. Thereafter, the voltage measurement-in-progress flag is reset. FIG. 11 is a flowchart detailing the procedure of SVD measurement to be performed by the computer 13. During SVD measurement, for example, a voltage across a built-in lithium battery (3.0 V) is measured to see if the voltage had dropped to a set voltage (for example, 2.4 V, 2.5 V, 2.6 V, or 2.7 V). First, a request for measurement of the voltage across the built-in battery is issued to the computer 13 (step S91). When the request is issued, an SVD measurement request flag is set (step S92), and an SVD request input is set to 1 (step S93).

Thereafter, when a predetermined time (200 $\mu$sec) has elapsed (step S94), the SVD request input is reset to 0 (step S95). Thereafter, it is checked if the result of SVD measurement is 1 (step S96). If the result is 1, a battery voltage-lowered flag is set (step S97). If the result is not 1, the battery voltage-lowered flag is reset and processing is terminated (step S98).

Figure 12:
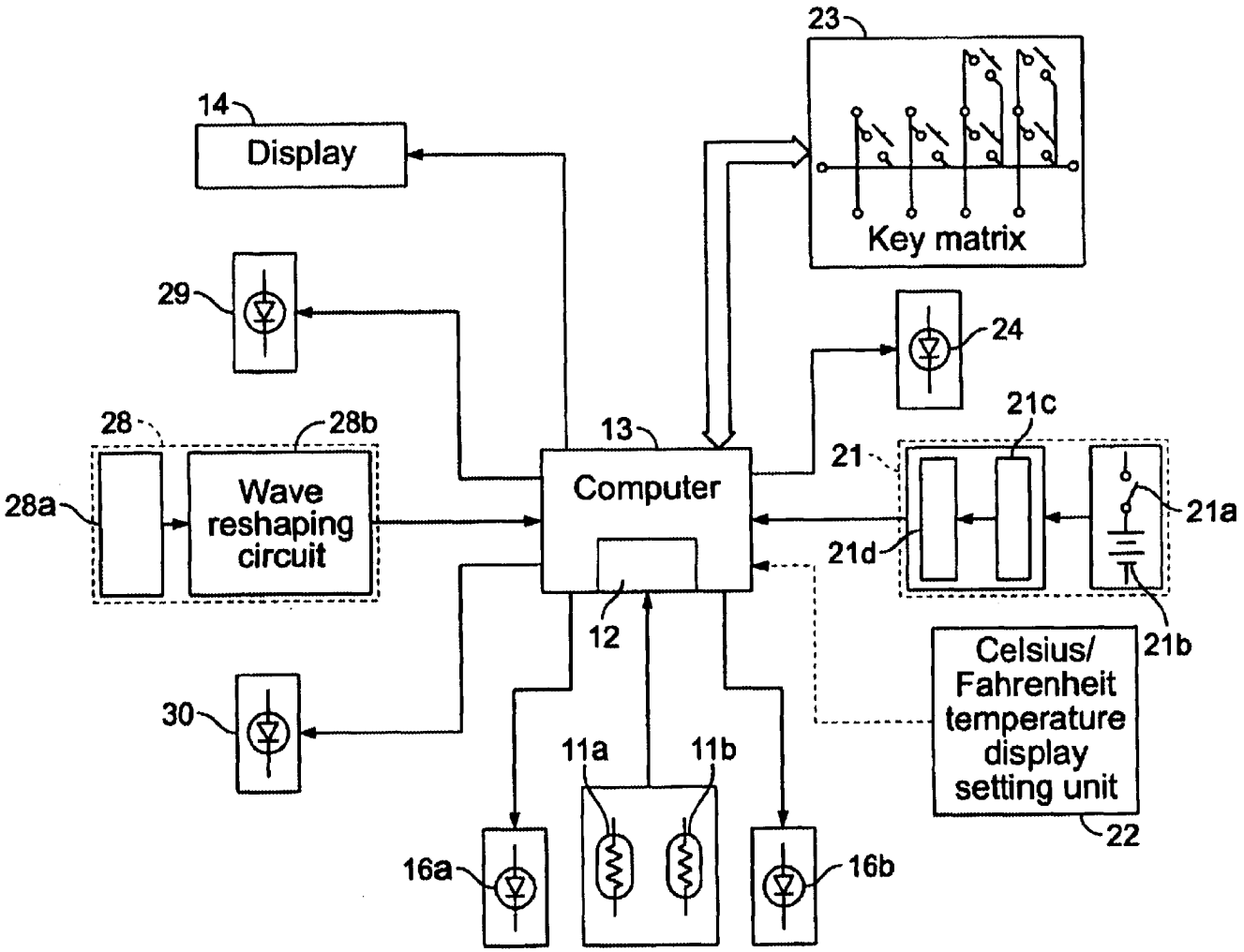
FIG. 12 is a block diagram showing a thermometer for an engine of a vehicle in accordance with another embodiment of the present invention.

Referring to FIG. 12, another embodiment of the present invention will be described below. In FIG. 12, the same reference numerals are assigned to the components identical to those shown in FIG. 1. Reiteration will be averted. FIG. 12 shows, in addition to the components shown in the block diagram of FIG. 7, an engine speed detecting unit 28 that detects an engine speed, a shift timing point indicator 29, and a shift timing warning indicator 30. Moreover, keys for use in determining a shift timing point revolution speed or a shift timing warning revolution speed are added to a key matrix unit 17.

Consequently, when a driver uses the keys included in the key matrix unit 23 to determine the shift timing point revolution speed, if the computer 13 verifies that the engine is revolved at an engine speed equal to or higher than the shift timing point revolution speed and equal to or lower than the shift timing warning set revolution speed, the computer 13 lights or flickers the shift timing point indicator 29. Consequently, a racer who is a driver may shift the transmission gear under an optimal condition at the timing of lighting or flickering the indicator.

Moreover, assume that the keys included in the key matrix unit 23 are used to determine the shift timing warning set revolution speed. In this case, when the engine speed reaches the shift timing warning set revolution speed, the computer 13 transmits a lighting signal to the shift timing warning indictor 30 so as to thus light or flicker the indicator. Consequently, the lighting or flickering of the shift timing warning indicator 30 enables a driver to recognize that shifting the transmission gear is inhibited. Breakage of a transmission or a clutch occurring when the transmission gear is forcibly shifted can be avoided.

Incidentally, the engine speed detecting unit 28 includes: an ignition noise detector 28*a* that detects an ignition noise occurring in the engine; and a wave reshaping circuit 28*b* that reshapes the wave of the ignition noise so as to thus convert it into a rectangular-wave pulsating signal, and transfers the pulsating signal to the computer 13. Moreover, in the present embodiment, two temperature/resistance elements 11*a* and 11*b* are juxtaposed. Consequently, the temperature of the engine can be monitored at two places at the same time. This results in high-precision temperature detection.

Moreover, stopwatch measurement, lap time measurement, split second measurement, or lap time/split second storage can be designated arbitrarily using the keys included in the key matrix unit 23. If necessary, an external operating member may be placed by the side of the operating keys included in the key matrix. In this case, the start or stop of stopwatch measurement or the like can be determined even during running of a vehicle. Furthermore, if an on-vehicle engine selecting switch is included in the key matrix unit 23, a type of engine that is an object of measurement can be determined arbitrarily.

Moreover, a light guide plate that has a light-emitting diode as a light source, refracts light at right angles with respect to a direction of propagation in which light is propagated, and glows on a planar basis may be placed below a liquid crystal display panel. In this case, during running of a vehicle at night, the temperature of an engine, a voltage across a battery, and other display data can be clearly displayed on the liquid crystal display panel employed in the display 14 shown in FIG. 1, FIG. 7, and FIG. 12.

Figure 13:
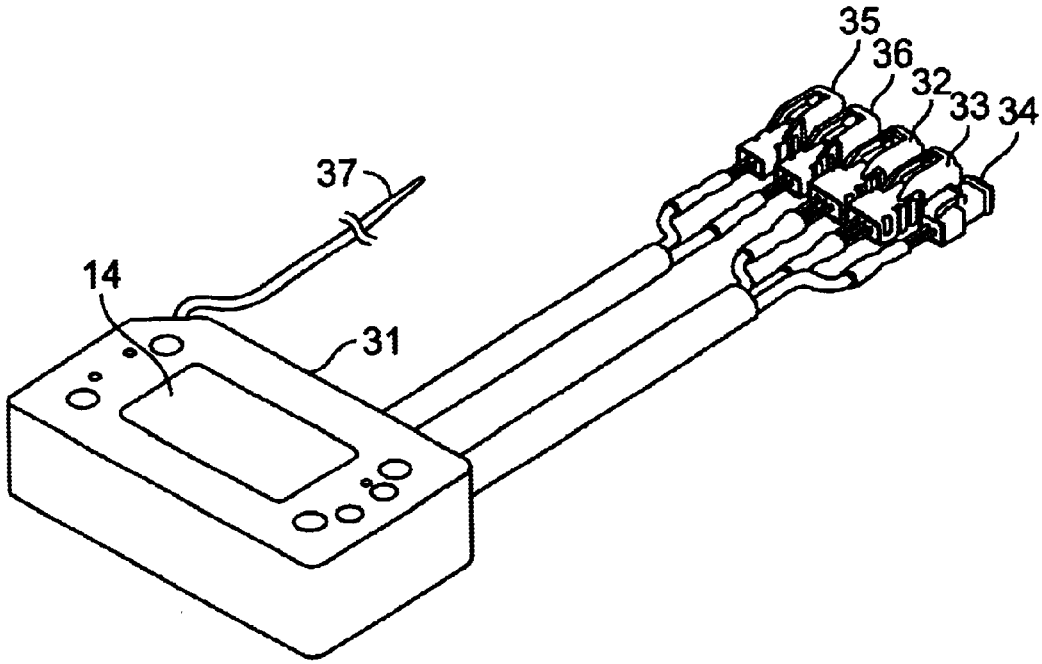
FIG. 13 is a perspective view showing the thermometer for an engine of a vehicle shown in FIG. 12.

FIG. 13 is a perspective view of the thermometer shown in FIG. 12. The two temperature/resistance elements 11*a* and 11*b*, the computer 13, the display 14, the battery voltage detecting unit 21, a Celsius/Fahrenheit temperature display setting unit 22, the key matrix unit 23, two temperature warning indicators 16*a* and 16*b*, a voltage warning indicator 24, the engine speed detecting unit 28, the shift timing point indicator 29, and the shift timing warning indicator 30 are housed in a case 31. In the same drawing, reference numerals 32 and 33 denote connectors coupled to the computer 13 over leads. The connectors 32 and 33 can be optionally joined to the respective contact pins of the two temperature/resistance elements 11*a* and 11*b* mounted on part of the engine.

Reference numeral 34 denotes a connector having pins thereof connected to a power supply pin of a battery, through which power is supplied to the circuits housed in the case 31 and to an ignition circuit incorporated in the engine. Reference numerals 35 and 36 denote connectors to be connected to the operating keys included in the key matrix unit 23. Reference numeral 37 denotes an antenna lead that serves as an integral part of the engine speed detecting unit 31. The antenna lead 37 is used to detect an ignition noise, which occurs in the engine, on the basis of an electromagnetic induction.

Consequently, the computer 13 acquires temperature data concerning the engine from the temperature/resistance elements 11*a* and 11*b* via the connectors 32 and 33. The computer 13 receives a supply voltage via the connector 34. Moreover, the computer 13 receives an input entered using an external key via the connector 35 or 36.

According to the present embodiment, as mentioned above, when the engine speed detected by the engine speed detecting unit 28 is equal to or lower than the shift timing warning set revolution speed and falls below the shift timing point revolution speed, the shift timing point indicator 29 indicates the fact. Consequently, a driver discerns that the transmission gear can be shifted. Moreover, when the detected engine speed exceeds the shift timing warning set revolution speed, the shift timing warning indicator 30 is lit. Consequently, the driver is inhibited to shift the transmission gear with the engine speed at this level.

INDUSTRIAL APPLICABILITY

As mentioned so far, a thermometer for an engine of a vehicle in accordance with the present invention is arbitrarily and optionally incorporated in an existing vehicle. Consequently, the thermometer helps a driver shift a transmission gear at the optimal shift timing or accelerate a vehicle while checking the temperature of an engine of the running vehicle. The thermometer hardly causes the engine to generate a noise, and is preferable for running of a vehicle with fuel consumption suppressed low.

What is claimed is:

1. A thermometer for an engine of a vehicle, comprising:

a temperature/resistance element that is mounted on part of an engine incorporated in a vehicle and that detects the temperature of the engine as a change in resistance;

a resistance-frequency converter that is optionally connected to said temperature/resistance element and that converts the detected change in resistance into a change in frequency;

a computer that calculates the temperature of the engine on the basis of a frequency represented by an output of said resistance-frequency converter, and displays it on a display; and a key entry unit for use in setting a warning temperature of the engine to a value selected from among a plurality of predetermined values and thus determining the warning temperature, wherein:

when a temperature of the engine exceeds the warning set temperature determined using said key entry unit, said computer instructs a warning indicator to give a warning indication;

the thermometer further comprising an engine speed detecting unit that detects an engine speed, wherein;

said computer calculates an engine speed on the basis of an output of said engine speed detecting unit;

when the calculated engine speed is equal to or higher than a shift timing point revolution speed and is equal to or lower than a shift timing warning set revolution speed, a shift timing indicator is actuated.

2. The thermometer for an engine of a vehicle according to claim 1, wherein said computer has the ability to convert the temperature of the engine obtained using said resistance-frequency converter from a Celsius temperature to a Fahrenheit temperature or vice versa.

3. The thermometer for an engine of a vehicle according to claim 1, wherein said key entry unit is used to determine the warning temperature in either Celsius or Fahrenheit.

4. The thermometer for an engine of a vehicle according to claim 1, wherein said key input unit is a key matrix unit that permits a user to determine the warning temperature, a warning voltage, or the setting of a timer, to store, display, or reset a maximum temperature of the engine, or to designate whether the functions of circuits are activated or inactivated automatically or manually at the time of starting or stopping the engine.

5. The thermometer for an engine of a vehicle according to claim 1, wherein in stopwatch mode which is designated using said key entry unit and in which stopwatch measurement, lap time measurement, split second measurement, or lap time/split second storage is carried out, said computer displays on said display times measured during running of a vehicle.

6. The thermometer for an engine of a vehicle according to claim 1, further comprising a Celsius/Fahrenheit display setting unit that is used to specify in said computer whether the temperature of the engine obtained using said resistance-frequency converter is displayed on said display in Celsius or Fahrenheit.

7. The thermometer for an engine of a vehicle according to claim 1, wherein after the engine is stopped, when a set time has elapsed, said computer automatically halts all the functions of circuits except the function of a timer.

8. The thermometer for an engine of a vehicle according to claim 1, further comprising a shift timing warning indicator that is driven when the engine speed detected by said engine speed detecting unit is equal to or higher than a shift timing warning set revolution speed determined using said key entry unit.

9. A thermometer for an engine of a vehicle, comprising:

a temperature/resistance element that is mounted on part of an engine incorporated in a vehicle and that detects the temperature of the engine as a change in resistance;

a resistance-frequency converter that is optionally connected to said temperature/resistance element and that converts the detected change in resistance into a change in frequency;

a computer that calculates the temperature of the engine on the basis of a frequency represented by an output of said resistance-frequency converter, and displays it on a display; and a key entry unit for use in setting a warning temperature of the engine to a value selected from among a plurality of predetermined values and thus determining the warning temperature, wherein;

when the temperature of the engine exceeds the warning set temperature determined using said key entry unit, said computer instructs a warning indicator to give a warning indication;

the thermometer further comprising:

a battery voltage detecting unit that detects a voltage across a battery incorporated in the vehicle; and converts the detected voltage into a frequency; and a voltage warning indicator that when the voltage across the battery exceeds a pre-set warning voltage, gives a warning indication, wherein:

said computer calculates the voltage across the battery on the basis of the frequency represented by an output of said battery voltage detecting unit, and displays on said display the calculated voltage across the battery;

when the voltage across the battery exceeds the warning set voltage determined using said key entry unit, said voltage warning indicator gives a warning indication, wherein:

said battery voltage detecting unit includes a frequency division circuit that produces a signal whose frequency corresponds to an integral submultiple of the frequency into which the frequency of the voltage across the battery is converted and whose timing matches the data processing timing at which said computer processes data.

10. The thermometer for an engine of a vehicle according to claim 9, wherein said computer has the ability to convert the temperature of the engine obtained using said resistance-frequency converter from a Celsius temperature to a Fahrenheit temperature or vice versa.

11. The thermometer according to claim 9, wherein said key entry unit is used to determine the warning temperature in either Celsius or Fahrenheit.

12. The thermometer for an engine of a vehicle according to claim 9, wherein said key entry unit is a key matrix unit that permits a user to determine the warning temperature, a warning voltage, or the setting of a timer, to store, display, or reset a maximum temperature of the engine, or to designate whether the functions of circuits are activated or inactivated automatically or manually at the time of starting or stopping the engine.

13. The thermometer for an engine of a vehicle according to claim 9, wherein in stopwatch mode which is designated using said key entry unit and in which stopwatch measurement, lap time measurement, split second measurement, or lap time/split second storage is carried out, said computer displays on said display times measured during running of a vehicle.

14. The thermometer for an engine of a vehicle according to claim 9, further comprising a Celsius/Fahrenheit display setting unit that is used to specify in said computer whether the temperature of the engine obtained using said resistance-frequency converter is displayed on said display in Celsius or Fahrenheit.

15. The thermometer for an engine of a vehicle according to claim 9, wherein after the engine is stopped, when a set time has elapsed, said computer automatically halts all the functions of circuits except the function of a timer.

* * * * *